US008640818B1

(12) United States Patent
Weidner

(10) Patent No.: US 8,640,818 B1
(45) **Date of Patent: *Feb. 4, 2014**

(54) SPEAKER ENCLOSURE

(71) Applicant: Michael Weidner, Oshkosh, WI (US)

(72) Inventor: Michael Weidner, Oshkosh, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/863,859

(22) Filed: Apr. 16, 2013

Related U.S. Application Data

(63) Continuation of application No. 13/228,554, filed on Sep. 9, 2011, now Pat. No. 8,430,201.

(60) Provisional application No. 61/381,350, filed on Sep. 9, 2010.

(51) Int. Cl.
*A47B 81/06* (2006.01)

(52) U.S. Cl.
USPC ..... 181/199; 181/198

(58) Field of Classification Search
USPC ..... 181/198, 199
See application file for complete search history.

(56) References Cited

U.S. PATENT DOCUMENTS

| | | | | | |
|---|---|---|---|---|---|
| 5,197,103 | A * | 3/1993 | Hayakawa | ..... | 381/349 |
| 5,659,157 | A * | 8/1997 | Shulte | ..... | 181/156 |
| 5,821,471 | A * | 10/1998 | McCuller | ..... | 181/156 |
| 6,431,309 | B1 * | 8/2002 | Coffin | ..... | 181/156 |
| 7,136,498 | B1 * | 11/2006 | Schott | ..... | 381/351 |
| 7,454,025 | B2 * | 11/2008 | Saiki | ..... | 381/161 |
| 7,463,746 | B2 * | 12/2008 | Caron et al. | ..... | 381/345 |
| 8,430,201 | B1 * | 4/2013 | Weidner | ..... | 181/199 |
| 2010/0177921 | A1 * | 7/2010 | Bos | ..... | 381/351 |

* cited by examiner

*Primary Examiner* — Forrest M Phillips
(74) *Attorney, Agent, or Firm* — Brannen Law Office, LLC

(57) ABSTRACT

The present invention relates to speaker enclosures utilizing the golden ratio geometrically throughout the design to reduce reflections, resonance and phase shifting, and to improve the transient response. Enclosures can be box-shaped, trapezoidal, suspended or otherwise configured. The enclosure has a driver wall, a baffle and a rear wall. The driver wall and baffle define a front chamber, and the baffle and rear wall define a rear chamber. The volumetric ratio between the rear chamber and front chamber can be approximately 0.6. The rear chamber also can have braces or dividers that segment the chamber into a central portion and two side portions. The volumetric ratio between the side portions and the central portion can be approximately 0.6. Ports of various configurations are provided. Braces can be used in conjunction with the ports to diffuse the incoming air. The baffle can have a plurality of radiused holes there through.

15 Claims, 12 Drawing Sheets

SPEAKER ENCLOSURE

This United States utility patent application claims priority on and the benefit of pending U.S. Utility application Ser. No. 13/228,554 filed Sep. 9, 2011, which itself claims priority on and the benefit of provisional application 61/381,350 filed Sep. 9, 2010, the entire contents of each are hereby incorporated herein by reference.

BACKGROUND OF THE INVENTION

1. Field of the Invention

The present invention relates to speaker enclosures and in particular to speaker enclosures utilizing the golden ratio geometrically throughout the design to reduce reflections, resonance and phase shifting, and to improve the transient response.

2. Description of the Related Art

Speakers and speaker enclosures have been evolving for many years. In the most basic setup, a speaker or driver is mounted in an open air structure. Improvements can be found when the speaker is housed within an enclosure. Some of the many improvements are illustrated in the following published application and patents:

United States Published Application Number 2010/0177921 to Bos is titled Response Speaker System. This application teaches that a sound generator like a guitar supplies an electrical output to operate speakers that are mounted in a chassis. The electrical output is divided into three frequency ranges, separately amplified and delivered to speakers mounted in a three separate enclosures each acoustically isolated from the other.

U.S. Pat. No. (hereafter "USPN") 7,136,498 to Schott is titled Loudspeaker Having a Dual Chamber Acoustical Enclosure with Two External Vents and One Internal Vent. In this patent, it is seen that a loudspeaker with an acoustical enclosure having an internal wall dividing the enclosure into first and second subchambers, an electro-acoustical transducer having a vibratable speaker cone mounted in an opening in the internal wall of the acoustical enclosure, an internal vent in the internal wall of the acoustical enclosure for pneumatically coupling the first and second subchambers, a first external vent in a wall of the first subchamber for pneumatically coupling the first subchamber to an exterior environment outside of the acoustical enclosure, and a second external vent in a wall of the second subchamber for pneumatically coupling the second subchamber to the exterior environment, a ratio of the acoustic masses of the internal vent to the second external vent being approximately 3/1 to 7/1, and a ratio of the acoustic masses of the first external vent to the second external vent being approximately 15/1 to 30/1 is provided.

U.S. Pat. No. 3,777,844 to Johnson is titled Adjustable Speaker Cabinet. This patent shows an acoustical cabinet for housing one or more loud speakers. The cabinet is broken up into a plurality of separate chambers and resonance volumes by means of horizontal partitions across the rectangular chamber. Each of the horizontal dividing walls has a plurality of circular openings therein. The speaker or speakers is mounted to a horizontal baffle across the entire cross section of the chamber. The resonance volumes above the speaker are partially vented, through pluralities of circular openings in the front panels of those chambers. The chambers below the speaker are likewise vented to the back through pluralities of circular openings.

None of these references show the use of the golden ratio between both front and rear chambers, as well as within the rear chamber, regardless of overall length, width and height dimensions of the enclosure.

None of these references disclose the use of diffusers to reduce chuffing.

None of these references teach the use of radiused internal passages or holes that reduce energy loss of the moving air masses.

None of these references teach the use of an elongated port to increase the port length and thereby increase port performance.

Thus there exists a need for speaker enclosures that solves these and other problems.

SUMMARY OF THE INVENTION

The present invention relates to speaker enclosures utilizing the golden ratio geometrically throughout the design to reduce reflections, resonance and phase shifting, and to improve the transient response. The enclosure has a driver wall, a baffle and a rear wall. The driver wall and baffle define a front chamber, and the baffle and rear wall define a rear chamber. The volumetric ratio between the rear chamber and front chamber can be approximately 0.6. The rear chamber also can have dividers that segment the chamber into a central portion and two side portions. The volumetric ratio between the side portions and the central portion can be approximately 0.6. Forward or rearward ports can be incorporated in the enclosure. Braces can be used in conjunction with the ports to diffuse the incoming air. In other embodiments, the baffle can have a plurality of radiused holes there through.

According to one advantage of the present invention, the use of the golden ratio between the rear and front chambers, and also within the rear chamber reduces reflections, reduces resonance and reduces phase shifting.

According to another advantage of the present invention, the use of volumetric ratios can be incorporated regardless of overall length, width and height dimensions of the speaker enclosure.

According to a further advantage of the present invention, a center baffle is provided to manipulate the internal air mass within the enclosure.

According to a still further advantage of one embodiment of the present invention having ports open to the rear and exiting into the front chamber, braces are provided to diffuse the air. This advantageously prevents chuffing as air enters through the ports.

According to a still further advantage yet of the present invention, the center baffle has holes with radiused edges, which reduce energy loss of the air mass as it moves within the enclosure.

According to a still further advantage yet of the present invention, the enclosure can accommodate multiple drivers, which can result in positive excitations in the main driver. This can be seen in one embodiment wherein the baffle is ported for an excitation driver.

According to another embodiment of the present invention, an elongated port design is shown. The port design has an increased length and a path that is arcuate or spiral in design. In one embodiment, the spiral design is a golden spiral, which is a spiral defined by the golden ratio. The port design also has a cross-sectional area that continuously decreases along the path length.

According to a further embodiment, a suspended driver section is shown in combination with a fixed external section. This advantageously allows for rear braces to be fixed while the driver is suspended. This allows port output around the entire circumference of the driver to reinforce the driver output. The fixed braces also provide an extension of the effective port length.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
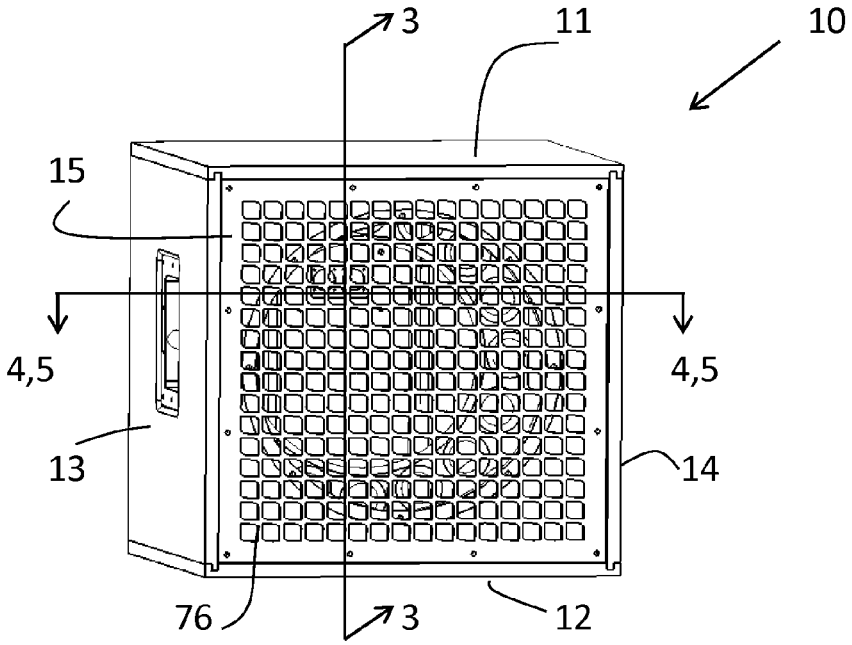
FIG. 1 is a perspective view of one preferred embodiment of the present invention.
Figure 2:
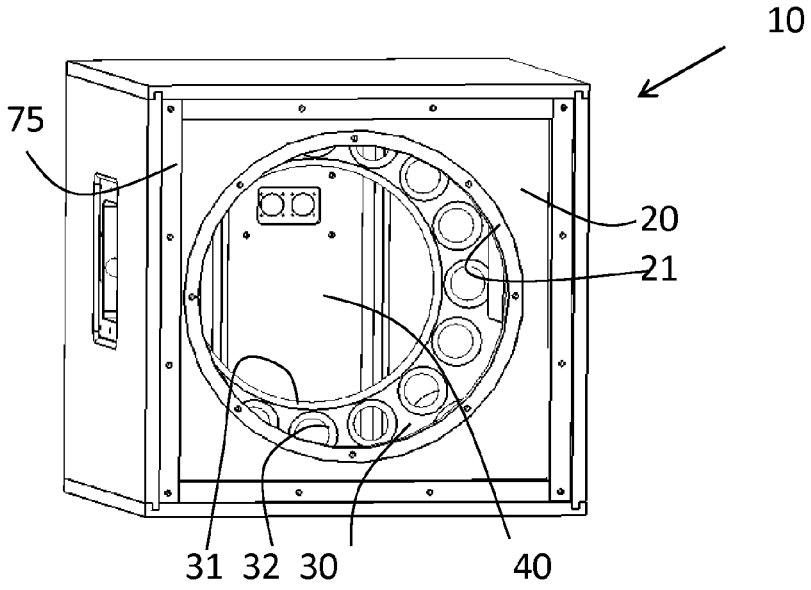
FIG. 2 is perspective view of the embodiment illustrated in FIG. 1, but without a grill in place.
Figure 3:
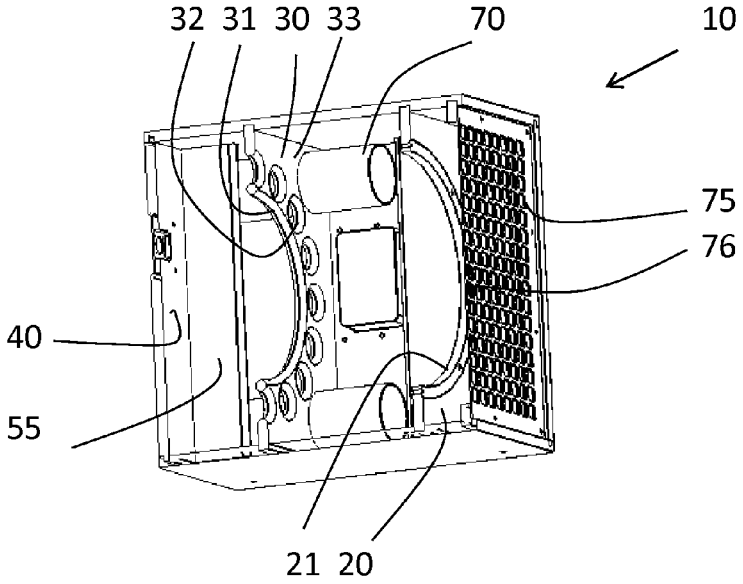
FIG. 3 is a cross-sectional view taken along line 3-3 in FIG. 1.
Figure 4:
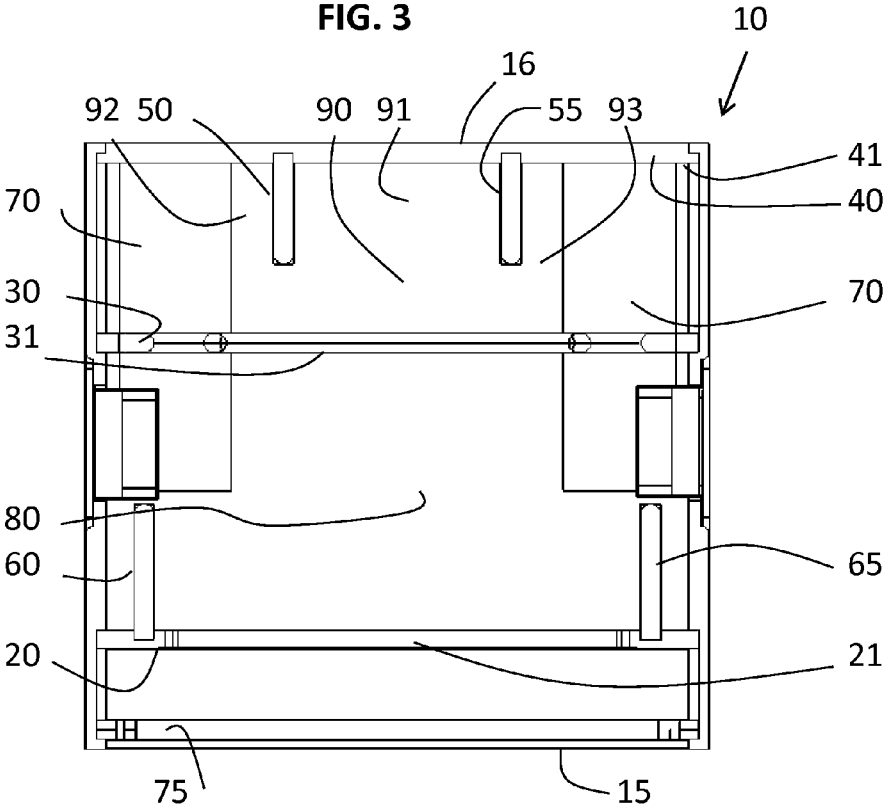
FIG. 4 is a cross-sectional view taken along line 4-4 in FIG. 1.
Figure 5:
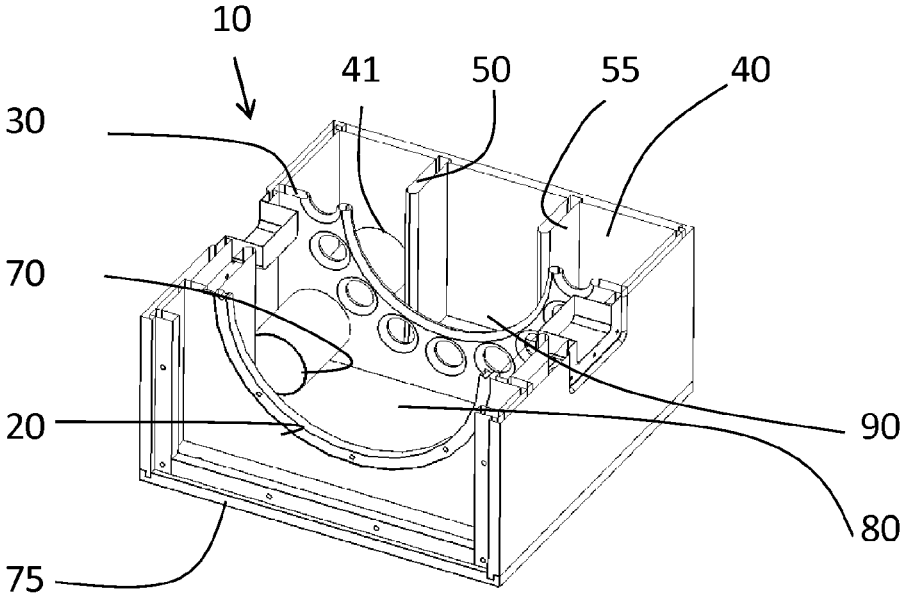
FIG. 5 is a perspective cross-sectional view taken along line 5-5 in FIG. 1.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-5, it is seen that one embodiment of an enclosure 10 is illustrated. The enclosure 10 has a top 11, a bottom 12, sides 13 and 14, a front 15 and a rear 16. It is understood that the enclosure can be reoriented without departing from the broad aspects of the present invention, and for sake of clarity, a single forward facing orientation is described. The enclosure can be made of many materials, including but not limited to multi-ply wood.

A driver wall 20 provided having a generally circular driver mount 21 formed there through. The driver wall 20 is preferably forward facing, and is located near the front 15 of the enclosure 10. The driver wall 20 is preferably generally planar and vertically oriented within the enclosure 10. The driver mount 21 defines a hole with a central axis that is preferably generally perpendicular the plane of the driver wall 20.

A baffle 30 is further provided. The baffle 30 has a central hole 31, and preferably a plurality of smaller perimeter holes 32 spaced preferably equidistantly around the central hole 31. The sum of the areas of the perimeter holes has a ratio to the area of the central hole of approximately 0.6 to 1.0. Further, this ratio can range from approximately 0.3 to 1.0 to a ratio of 1.0 to 1.0. The central hole 31 and the perimeter holes 32 preferably have radiused edges. Four port passages 33 are also provided. The baffle 30 is preferably generally planar and vertically oriented within the enclosure 10. In this regard, the baffle 30 is preferably parallel to the driver wall 20. The central hole 30 is preferably concentric with the driver mount hole 21. The perimeter holes each have central axis that are preferably parallel to the central hole central axis. It is appreciated that while central hole 31 and the perimeter holes 32 are shown to be generally circular in profile, that they could embody alternative shapes without departing from the broad aspects of the present invention.

A rear wall 40 is also provided. The rear wall 40 has four port openings 41 there through. The rear wall 40 is preferably generally parallel to the baffle 30 and to the driver wall 20. Enclosure 10 is shown to be a passive enclosure that is not optimized for on board amplifiers. However, it is understood that enclosure 10 could be constructed for amplifiers without departing from the broad aspects of the present invention.

Two rear braces 50 and 55 are shown and are preferably connected to the rear wall 40. The rear braces are preferably perpendicular to the rear wall 40, and span between the top 11 and bottom 12 of the enclosure 10. The braces 50 and 55 extend towards but do not reach the baffle 30.

Front braces 60 and 65 are also shown and are preferably connected to the driver wall 20. The front braces 60 and 65 extend rearward from the driver wall 20 and are connected to the driver wall. Braces 60 and 65 extend towards the baffle 30 but do not reach the baffle. They span between the top 11 and bottom 12 of the enclosure 10. Braces 60 and 65 are preferably parallel to each other.

Ports 70 are provided and are open to the rear 16 of the enclosure 10. The ports 70 extend through port openings 41 in the rear wall 40, extend through port passages 33 in the baffle 30 and extend in front of the baffle. Four ports are preferably provided. Yet, it is understood the more or fewer may be utilized without departing from the broad aspects of the present invention.

A grill wall 75 supporting a grill 76 is provided. The grill wall 75 is at the front 15 of the enclosure 10 in front of the driver wall 20.

The front wall 20 and baffle 30 define a front chamber 80. The baffle 30 and rear wall 40 define a rear chamber 90. In a preferred embodiment, the volumetric ratio between the rear chamber 90 and front chamber 80 is 0.6:1. Yet, it is appreciated that a range of ratios, including up to but not limited to 1:1 and including down to but not limited to 0.3:1, can be used without departing from the broad aspects of the present invention.

It is appreciated that because the enclosure 10 can have a different orientation, that the front chamber can actually be above, below, beside or behind the rear chamber. Further, the enclosure can also be described to have a large chamber and a small chamber. In this illustrated embodiment, the large chamber is the front chamber, and the small chamber is the rear chamber.

The ports 70 are open to the front chamber 80, and are diffused by braces 60 and 65. In this regard, the braces 60 and 65 are preferably at least partially aligned with the ends of the ports 70.

The rear braces 50 and 55 divide the rear chamber 90 into a center portion 91 and two side portions 92 and 93. In a preferred embodiment, the volumetric ratio between the center portion 91 and the sum of the side portions 92 and 93 is 0.6:1. Yet, it is appreciated that a range of ratios, including up to but not limited to 1:1 and including down to but not limited to 0.3:1, can be used without departing from the broad aspects of the present invention.

Air flows through the enclosure 10 based on differences in pressure at different parts of the enclosure. Controlling the internal dampening is accomplished by directing air flow within the enclosure 10 to manipulate inertia of the driver's components. It is appreciated that the passages may be tuned to selected frequencies within the enclosure.

It is appreciated that multiple drivers can be incorporated into the design of the present invention.

Figure 6:
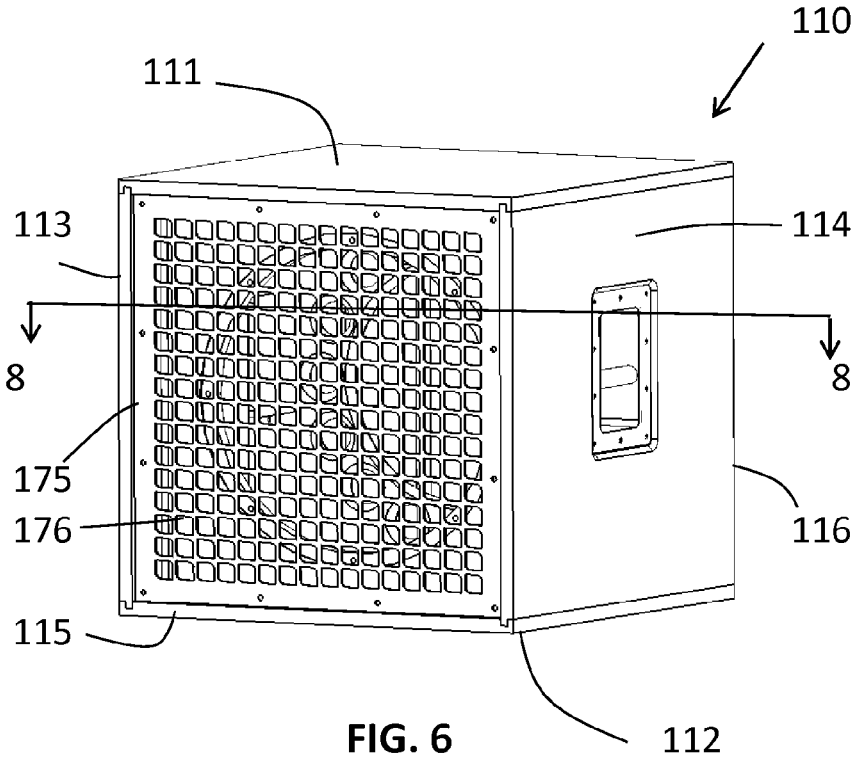
FIG. 6 is a perspective view of an alternative embodiment of the present invention.
Figure 7:
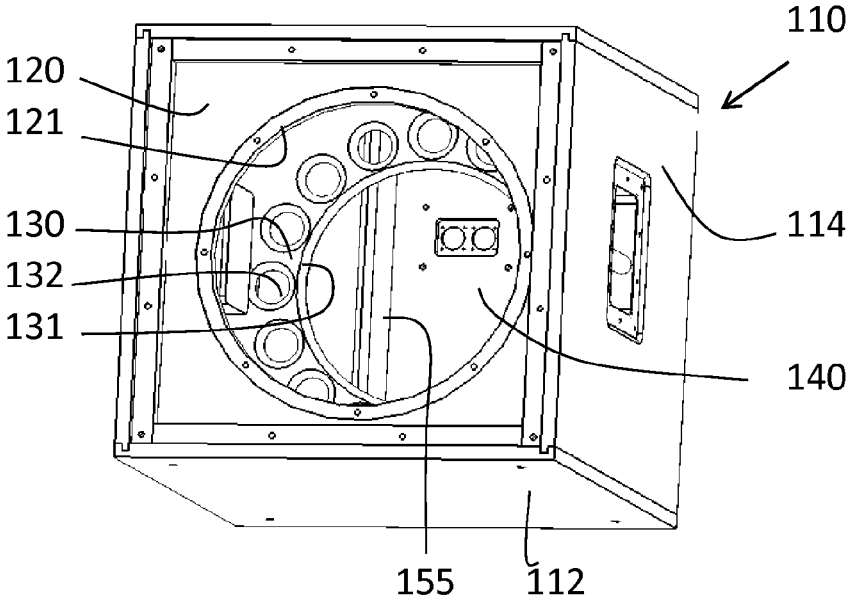
FIG. 7 is a perspective view of the embodiment illustrated in FIG. 6, but is illustrated without a grill in place.
Figure 8:
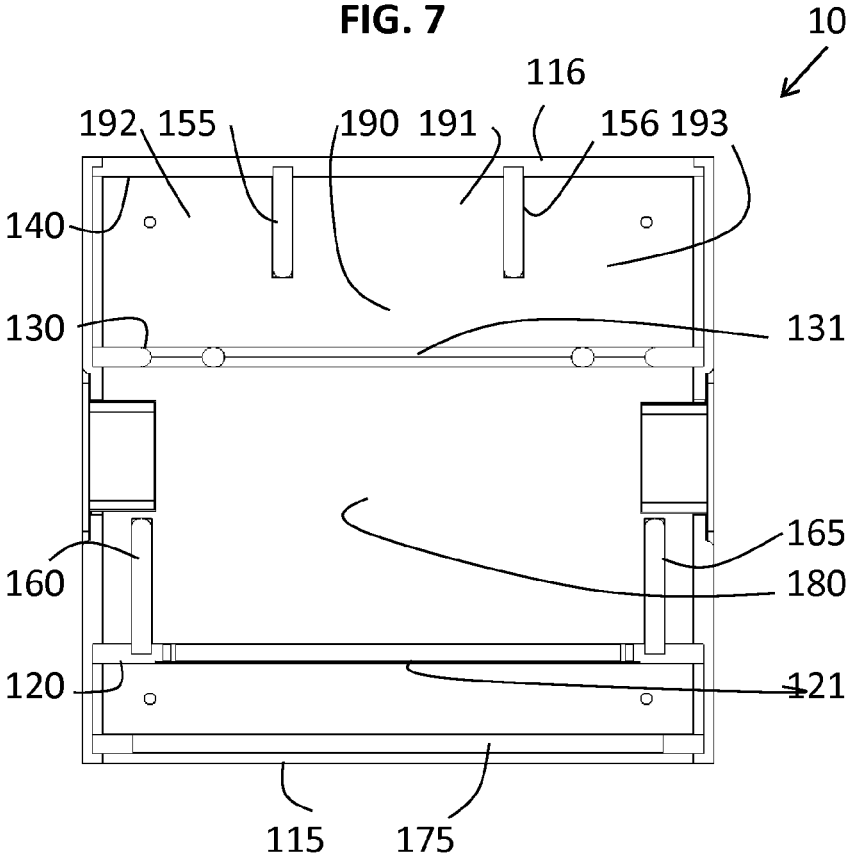
FIG. 8 is a cross-sectional view taken along line 8-8 in FIG. 6.

Turning now to FIGS. 6-8, it is seen that an alternative embodiment of the enclosure 110 is illustrated. The enclosure 110 has a top 111, a bottom 112, sides 113 and 114, a front 115 and a rear 116. While overall exterior dimensions are shown, it is appreciated that the dimensions may vary without departing from the broad aspects of the present invention.

A driver wall 120 provided having a generally circular driver mount 121 formed there through. The driver wall 120 is preferably forward facing, and is located near the front 115 of the enclosure 110. The driver wall 120 is preferably generally planar and vertically oriented within the enclosure 110. The driver mount 121 defines a hole with a central axis that is preferably generally perpendicular the plane of the driver wall 120.

A baffle 130 is further provided. The baffle 130 has a central hole 131, and preferably a plurality of smaller perimeter holes 132 spaced preferably equidistantly around the central hole 131. The sum of the areas of the perimeter holes has a ratio to the area of the central hole of approximately 0.6 to 1.0. Further, this ratio can range from approximately 0.3 to 1.0 to a ratio of 1.0 to 1.0. The central hole 131 and the perimeter holes 132 preferably have radiused edges. The baffle 130 is preferably generally planar and vertically oriented within the enclosure 110. In this regard, the baffle 130 is preferably parallel to the driver wall 120. The central hole 130 is preferably concentric with the driver mount hole 121. The perimeter holes each have central axis that are preferably parallel to the central hole central axis. It is appreciated that while central hole 131 and the perimeter holes 132 are shown to be generally circular in profile, that they could embody alternative shapes without departing from the broad aspects of the present invention.

A rear wall 140 is also provided. The rear wall 140 is preferably generally parallel to the baffle 130 and to the driver wall 120. Enclosure 110 is shown to be a passive enclosure, but could be active without departing from the broad aspects of the present invention.

Two rear braces 150 and 155 are shown and are preferably connected to the rear wall 140. The rear braces are preferably perpendicular to the rear wall 140, and span between the top 111 and bottom 112 of the enclosure 110. The braces 150 and 155 extend towards but do not reach the baffle 130.

Front braces 160 and 165 are also shown and are preferably connected to the driver wall 120. The front braces 160 and 165 extend rearward from the driver wall 120 and are connected to the driver wall. Braces 160 and 165 extend towards the baffle 130 but do not reach the baffle. They span between the top 111 and bottom 112 of the enclosure 110. Braces 160 and 165 are preferably parallel to each other.

A grill wall 175 supporting a grill 176 is provided. The grill wall 175 is at the front 115 of the enclosure 110 in front of the driver wall 120.

The front wall 120 and baffle 130 define a front chamber 180. The baffle 130 and rear wall 140 define a rear chamber 190. In a preferred embodiment, the volumetric ratio between the rear chamber 190 and front chamber 180 is 0.6:1. Yet, it is appreciated that a range of ratios, including up to but not limited to 1:1 and including down to but not limited to 0.3:1, can be used without departing from the broad aspects of the present invention.

The rear braces 150 and 155 divide the rear chamber 190 into a center portion 191 and two side portions 192 and 193. In a preferred embodiment, the volumetric ratio between the center portion 191 and the sum of the side portions 192 and 193 is 0.6:1. Yet, it is appreciated that a range of ratios, including up to but not limited to 1:1 and including down to but not limited to 0.3:1, can be used without departing from the broad aspects of the present invention.

Figure 9:
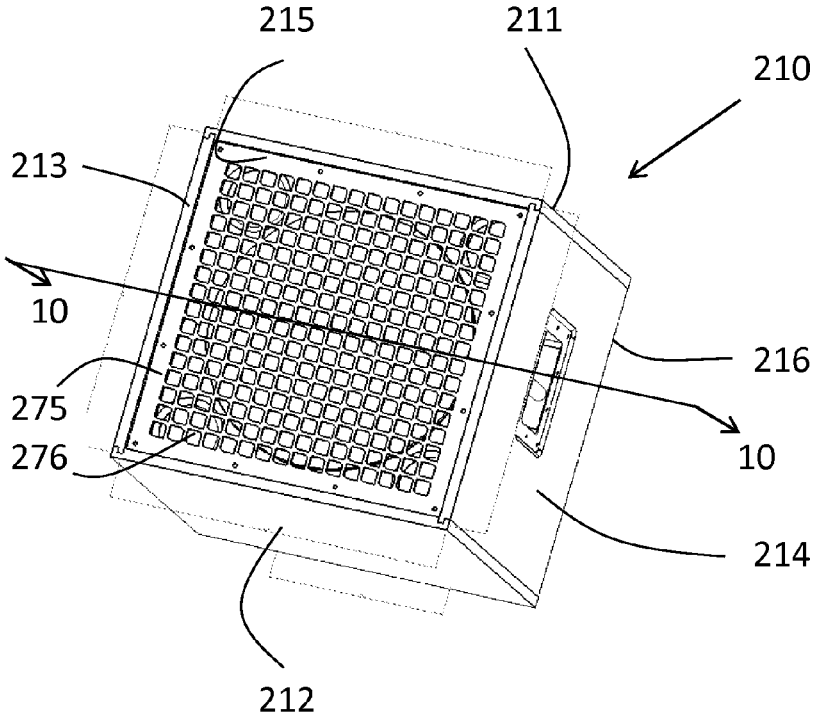
FIG. 9 is a perspective view of an additional alternative embodiment of the present invention.
Figure 10:
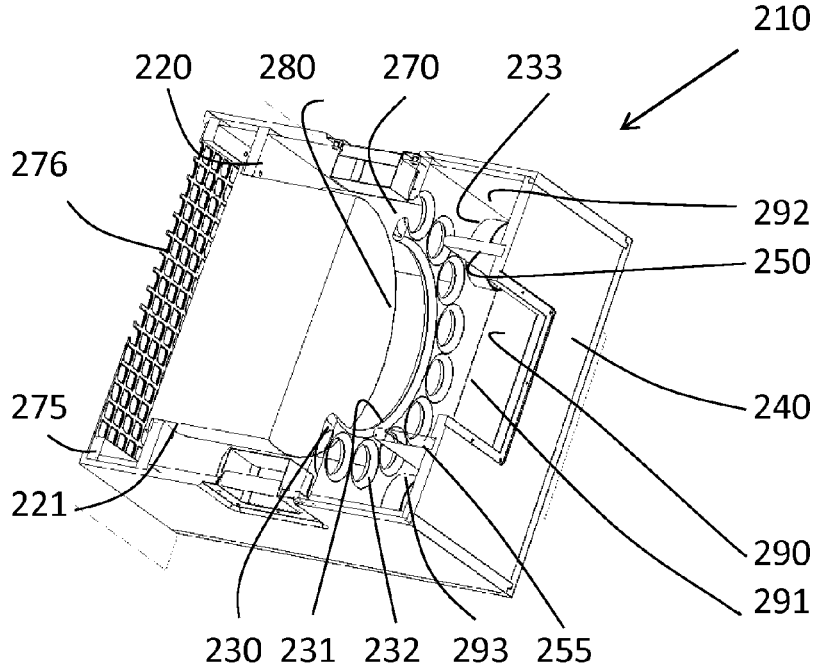
FIG. 10 is a cross-sectional view taken along line 10-10 in FIG. 9.
Figure 11:
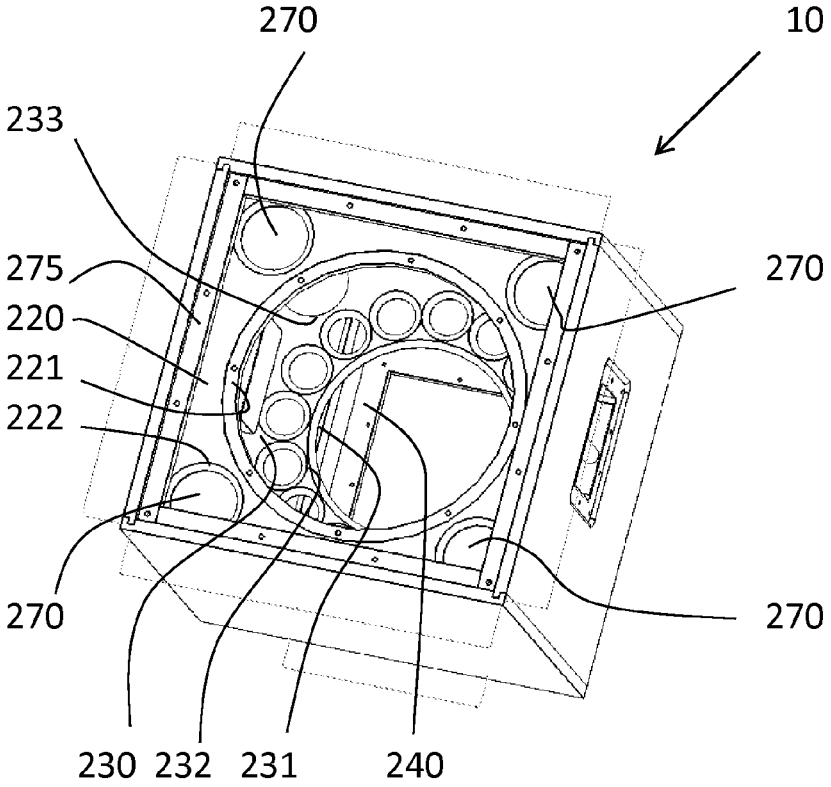
FIG. 11 is a perspective view of the embodiment illustrated in FIG. 9, but is illustrated without a grill in place.

Turning now to FIGS. 9-11, it is seen that an additional embodiment of an enclosure 210 is illustrated. The enclosure 210 has a top 211, a bottom 212, sides 213 and 214, a front 215 and a rear 216. The enclosure can be made of many materials, including but not limited to multi-ply wood.

A driver wall 220 provided having a generally circular driver mount 221 formed there through. The driver wall 220 is preferably forward facing, and is located near the front 215 of the enclosure 210. The driver wall 220 is preferably generally planar and vertically oriented within the enclosure 210. The driver mount 221 defines a hole with a central axis that is preferably generally perpendicular the plane of the driver wall 220. Four port openings 222 are provided, and extend through the driver wall 220 . . . .

A baffle 230 is further provided. The baffle 230 has a central hole 231, and preferably a plurality of smaller perimeter holes 232 spaced preferably equidistantly around the central hole 231. The sum of the areas of the perimeter holes has a ratio to the area of the central hole of approximately 0.6 to 1.0. Further, this ratio can range from approximately 0.3 to 1.0 to a ratio of 1.0 to 1.0. The central hole 231 and the perimeter holes 232 preferably have radiused edges. Four port passages 233 are also provided. The baffle 230 is preferably generally planar and vertically oriented within the enclosure 210. In this regard, the baffle 230 is preferably parallel to the driver wall 220. The central hole 230 is preferably concentric with the driver mount hole 221. The perimeter holes each have central axis that are preferably parallel to the central hole central axis. It is appreciated that while central hole 231 and the perimeter holes 232 are shown to be generally circular in profile, that they could embody alternative shapes without departing from the broad aspects of the present invention.

A rear wall 240 is also provided. The rear wall 240 is preferably generally parallel to the baffle 230 and to the driver wall 220. The enclosure 210 is shown as an active enclosure designed to accommodate an integrated amplifier. In this regard, the integrated amplifier (not shown) can be received within the large opening through the rear wall of the enclosure.

Two rear braces 250 and 255 are shown and are preferably connected to the rear wall 240. The rear braces are preferably perpendicular to the rear wall 240, and span between the top 211 and bottom 212 of the enclosure 210. The braces 250 and 255 extend towards but do not reach the baffle 230.

Ports 270 are provided and are open to the front of the driver wall 220. The ports 270 extend through port openings 222 in the driver wall 220, extend through port passages 233 in the baffle 230 and extend behind the baffle. Four ports are preferably provided. Yet, it is understood the more or fewer may be utilized without departing from the broad aspects of the present invention.

A grill wall 275 supporting a grill 276 is provided. The grill wall 275 is at the front 215 of the enclosure 210 in front of the driver wall 220.

The front wall 220 and baffle 230 define a front chamber 280. The baffle 230 and rear wall 240 define a rear chamber 290. In a preferred embodiment, the volumetric ratio between the rear chamber 290 and front chamber 280 is 0.6:1. Yet, it is appreciated that a range of ratios, including up to but not limited to 1:1 and including down to but not limited to 0.3:1, can be used without departing from the broad aspects of the present invention.

The ports 270 are open to the rear chamber 290.

The rear braces 250 and 255 divide the rear chamber 290 into a center portion 291 and two side portions 292 and 293. In a preferred embodiment, the volumetric ratio between the center portion 291 and the sum of the side portions 292 and 293 is 0.6:1. Yet, it is appreciated that a range of ratios, including up to but not limited to 1:1 and including down to but not limited to 0.3:1, can be used without departing from the broad aspects of the present invention.

Figure 12:
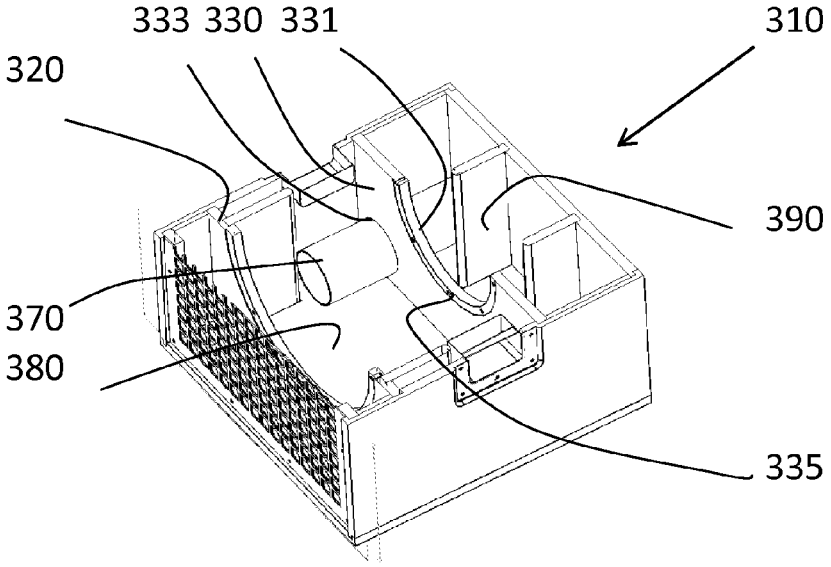
FIG. 12 is a cross-sectional view of an alternative embodiment of the present invention showing a sealed baffle (absent perimeter holes) that is ported around the central hole.
Figure 13:
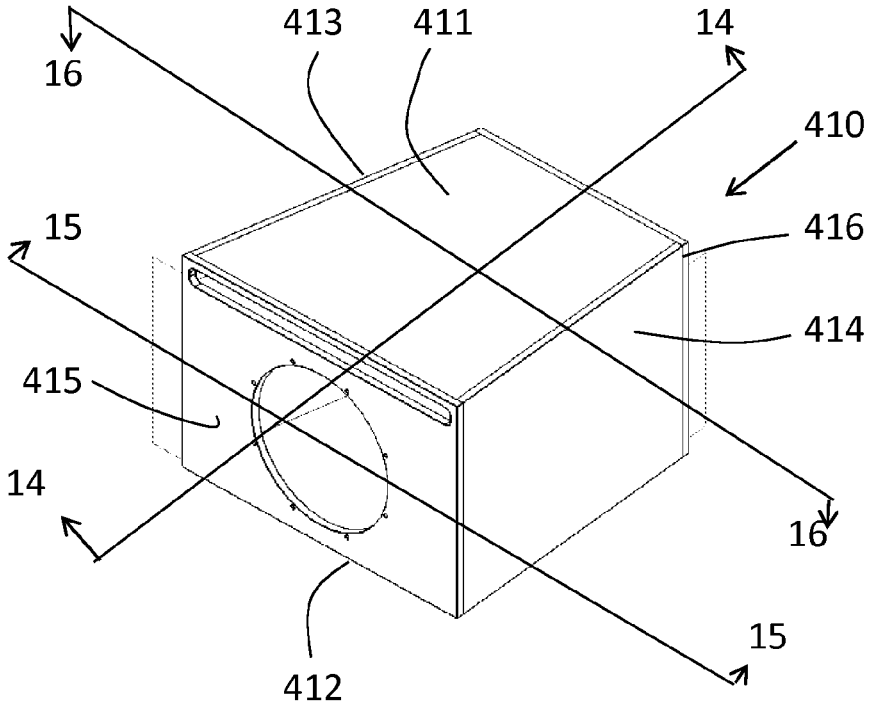
FIG. 13 is a perspective view of an alternative embodiment of the present invention.
Figure 14:
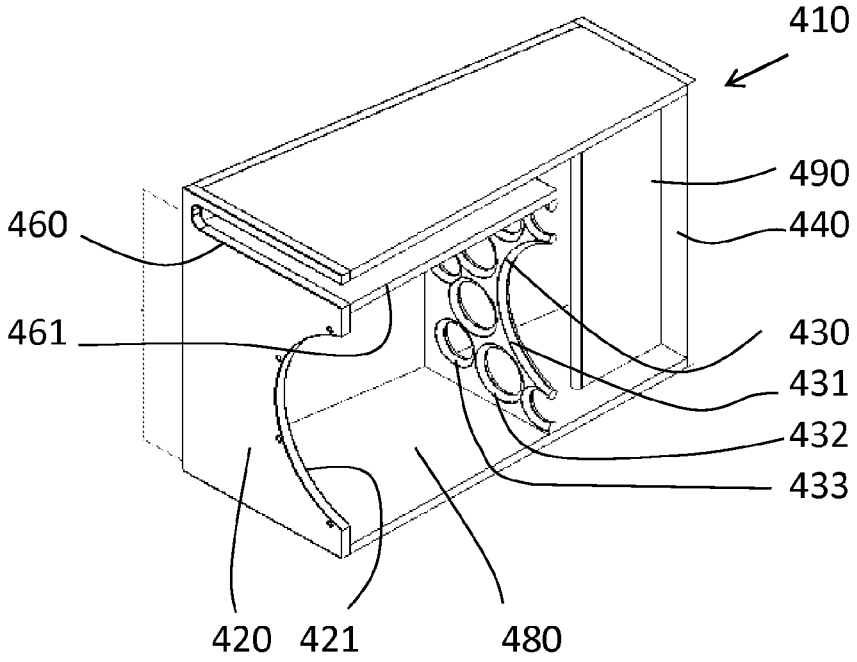
FIG. 14 is a sectional view taken along line 14-14 of FIG. 13.
Figure 15:
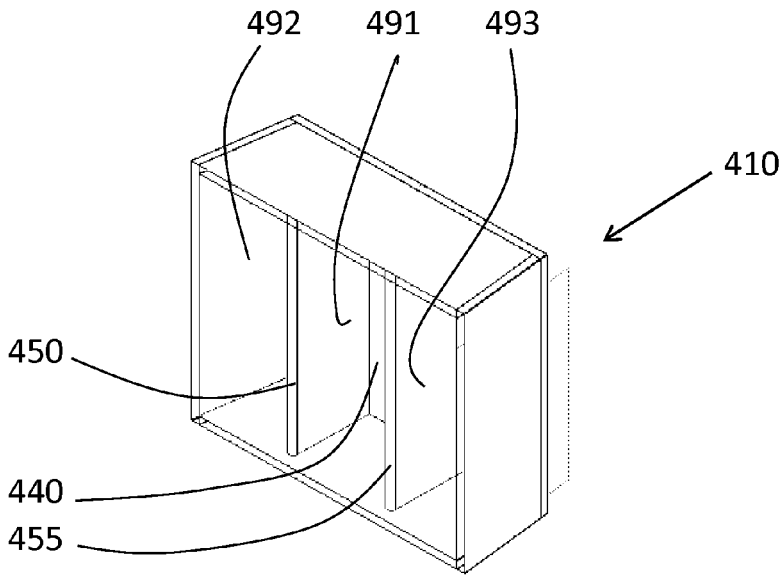
FIG. 15 is a sectional view taken along line 15-15 of FIG. 13.
Figure 16:
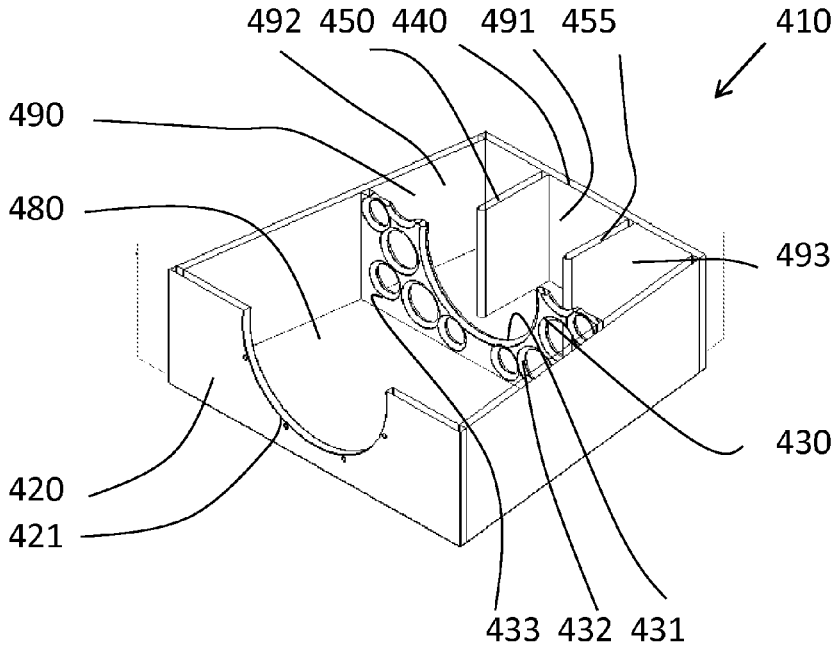
FIG. 16 is a sectional view taken along line 16-16 of FIG. 13.
Figure 17:
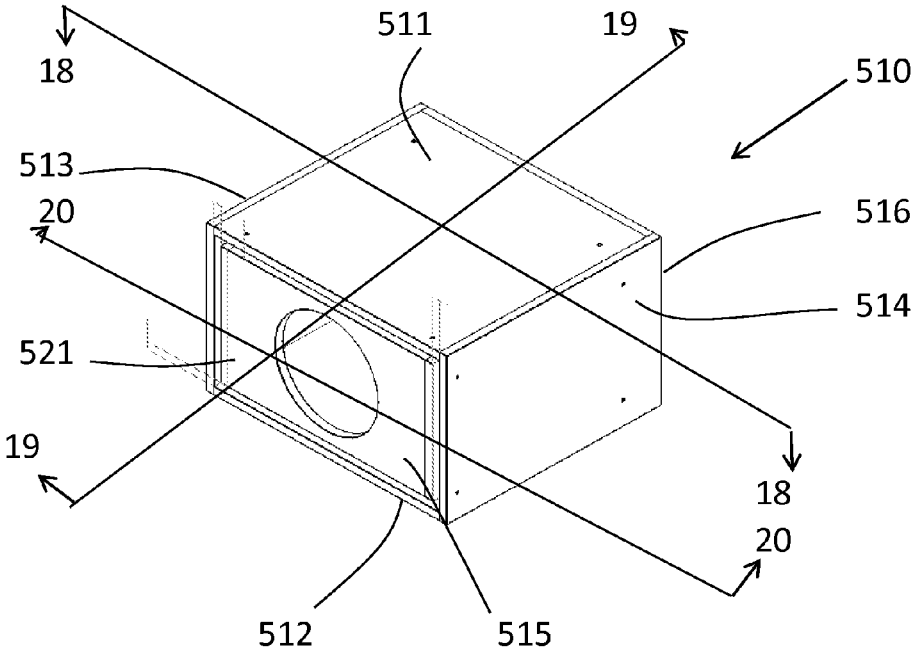
FIG. 17 is a perspective view of an alternative embodiment of the present invention.
Figure 18:
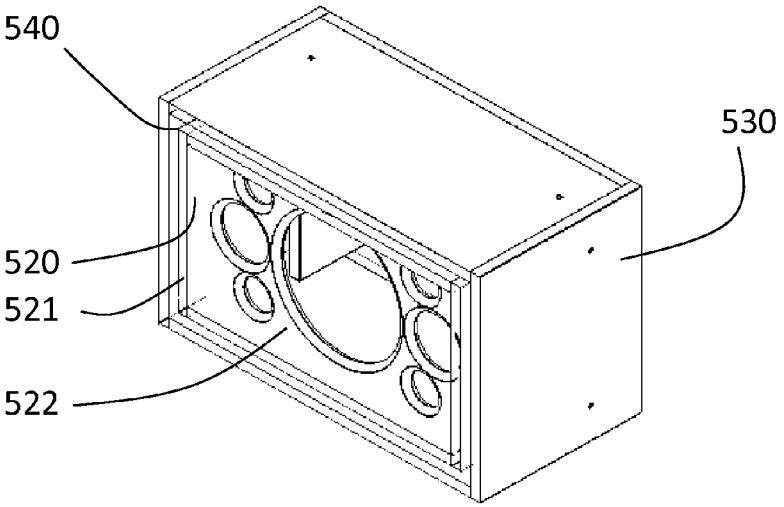
FIG. 18 is a sectional view taken along line 18-18 of FIG. 17.
Figure 19:
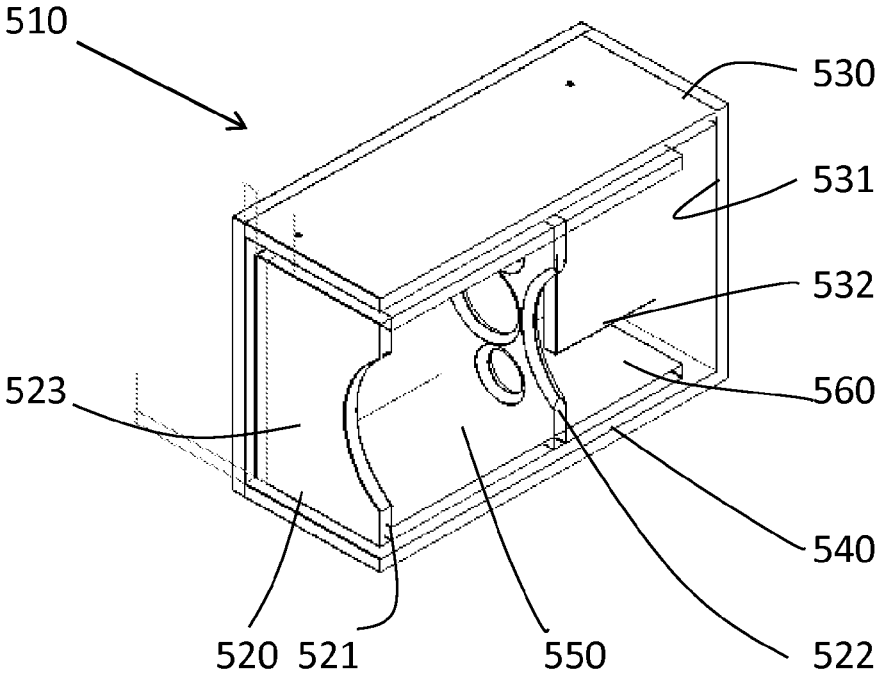
FIG. 19 is a sectional view taken along line 19-19 of FIG. 17.
Figure 20:
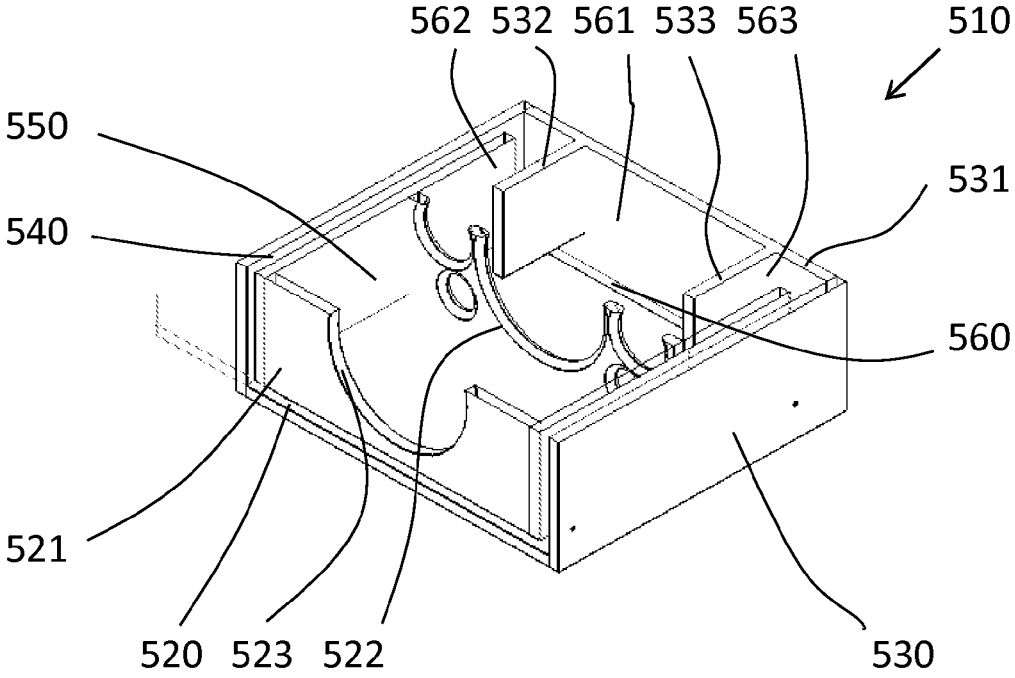
FIG. 20 is a sectional view taken along line 20-20 of FIG. 17.
Figure 21:
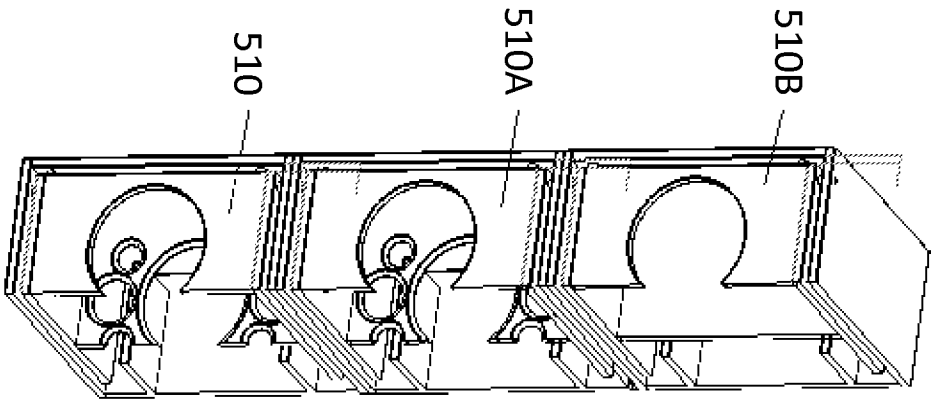
FIG. 21 is a cross-sectional stacked view of several suspended enclosures designed for different frequency drivers.

Turning now to FIG. 12 it is seen that a further alternative embodiment of an enclosure 310 is illustrated. In this embodiment, the enclosure 310 has a driver wall 320 and a baffle 330. The baffle 320 is a sealed baffle having a central hole 331, port passages 333 and driver ports 335. Perimeter holes (illustrated above) are absent in this embodiment. Ports 370 extend through the port passages 333. An excitation driver (not shown) can be mounted to the central hole 331 though the driver ports 335. The sealed baffle 330 thus forms a seal between a front chamber 380 and a rear chamber 390.

It is appreciated that while several embodiments are illustrated, that the present invention is not limited to the illustrated embodiments. For example, it is understood that an enclosure have several chambers (possibly completely isolated chambers) for tweeter, midrange, base and other frequencies can be provided.

It is also understood that, for example, a rear or front ported enclosure can incorporate a sealed baffle, or can incorporate a ported excitation driver.

Turning now to FIGS. 13-16, it is seen that an additional embodiment of an enclosure 410 is illustrated. The enclosure 410 has a top 411, a bottom 412, sides 413 and 414, a front 415 and a rear 416. The enclosure 410 in this embodiment has a generally trapezoidal design, wherein the front 415 is wider than the rear 416. While overall exterior dimensions are shown, it is appreciated that the dimensions may vary without departing from the broad aspects of the present invention.

A driver wall 420 provided having a generally circular driver mount 421 formed there through. The driver wall 420 is preferably forward facing, and is located near the front 415 of the enclosure 410. The driver wall 420 is preferably generally planar and vertically oriented within the enclosure 410. The driver mount 421 defines a hole with a central axis that is preferably generally perpendicular the plane of the driver wall 420.

A baffle 430 is further provided. The baffle 430 has a central hole 431, and preferably a plurality of smaller perimeter holes 432 spaced preferably equidistantly around the central hole 431. The sum of the areas of the perimeter holes has a ratio to the area of the central hole of approximately 0.6 to 1.0. Further, this ratio can range from approximately 0.3 to 1.0 to a ratio of 1.0 to 1.0. Secondary holes 433, which are preferably even smaller than the perimeter holes 432 are also provided, and are located further from the center of the central hole 431 than the perimeter holes 432. The sum of the areas of the secondary holes has a ratio to the sum of the areas of the perimeter holes of approximately 0.6 to 1.0. Further, this ratio can range from approximately 0.3 to 1.0 to a ratio of 1.0 to 1.0. The central hole 431, perimeter holes 432 and secondary holes 433 preferably have radiused edges. The baffle 430 is preferably generally planar and vertically oriented within the enclosure 410. In this regard, the baffle 430 is preferably parallel to the driver wall 420. The central hole 430 is preferably concentric with the driver mount hole 421. The perimeter holes each have central axis that are preferably parallel to the central hole central axis. It is appreciated that while central hole 431, the perimeter holes 432 and the secondary holes 433 are shown to be generally circular in profile, that they could embody alternative shapes without departing from the broad aspects of the present invention.

A rear wall 440 is also provided. The rear wall 440 is preferably generally parallel to the baffle 430 and to the driver wall 420.

Two rear braces 450 and 455 are shown and are preferably connected to the rear wall 440. The rear braces are preferably perpendicular to the rear wall 440, and span between the top 411 and bottom 412 of the enclosure 410. The braces 450 and 455 extend towards but do not reach the baffle 430.

A port 460 is also shown. The port 460 is defined by a front brace 461 that is near and parallel to the top 411 of the enclosure. The port 460 is open to the front 415 of the enclosure and open in front of the baffle 430.

The front wall 420 and baffle 430 define a front chamber 480. The baffle 430 and rear wall 440 define a rear chamber 490. In a preferred embodiment, the volumetric ratio between the rear chamber 490 and front chamber 480 is 0.6:1. Yet, it is appreciated that a range of ratios, including up to but not limited to 1:1 and including down to but not limited to 0.3:1, can be used without departing from the broad aspects of the present invention.

The rear braces 450 and 455 divide the rear chamber 490 into a center portion 491 and two side portions 492 and 493. In a preferred embodiment, the volumetric ratio between the center portion 491 and the sum of the side portions 492 and 493 is 0.6:1. Yet, it is appreciated that a range of ratios, including up to but not limited to 1:1 and including down to but not limited to 0.3:1, can be used without departing from the broad aspects of the present invention.

Turning now to FIGS. 17-21, it is seen that an additional embodiment of an enclosure 510 is illustrated. The enclosure 510 has a top 511, a bottom 512, sides 513 and 514, a front 515 and a rear 516. While overall exterior dimensions are shown, it is appreciated that the dimensions may vary without departing from the broad aspects of the present invention.

Enclosure 510 has a suspended section 520 and an external section 530. Each of these sections is described below.

Suspended section 520 has a housing 521, a baffle 522 and a driver wall 523. The baffle and driver wall are similar to those described herein above, and are not separately discussed here. The suspended section 520 has an inside and an outside.

The external section 530 has an inside and an outside. The external section further has a rear wall 531 with two braces 532 and 533 connected thereto. The braces 532 and 533 are perpendicular to the rear wall, and span between the top and bottom of the inside of the external section.

The suspended section 520 fits within the external section. The braces 532 and 533 extend into the volume of the suspended section towards the baffle 522. However, the braces 532 and 533 do not reach the baffle and are not connected to the suspended section 520.

A port 540 is provided, and is defined by the area between the inside of the external section 530 and the outside of the suspended section 520. In this regard, the port spans the entire circumference (or nearly the entire circumference) around the driver.

The driver wall 523 and baffle 522 define a front chamber 550. The baffle 522 and rear wall 531 define a rear chamber 560. In a preferred embodiment, the volumetric ratio between the rear chamber 560 and front chamber 550 is 0.6:1. Yet, it is appreciated that a range of ratios, including up to but not limited to 1:1 and including down to but not limited to 0.3:1, can be used without departing from the broad aspects of the present invention.

The rear braces 532 and 533 divide the rear chamber 560 into a center portion 561 and two side portions 562 and 563. In a preferred embodiment, the volumetric ratio between the center portion 561 and the sum of the side portions 562 and 563 is 0.6:1. Yet, it is appreciated that a range of ratios, including up to but not limited to 1:1 and including down to but not limited to 0.3:1, can be used without departing from the broad aspects of the present invention.

The port 540 in this embodiment is open to the front 515 of the enclosure. The port is also open into the rear chamber 560. In this regard, air entering through the port 540 must go around the fixed braces 532 and 533, which act together to extend the effective length of the port.

Figure 22:
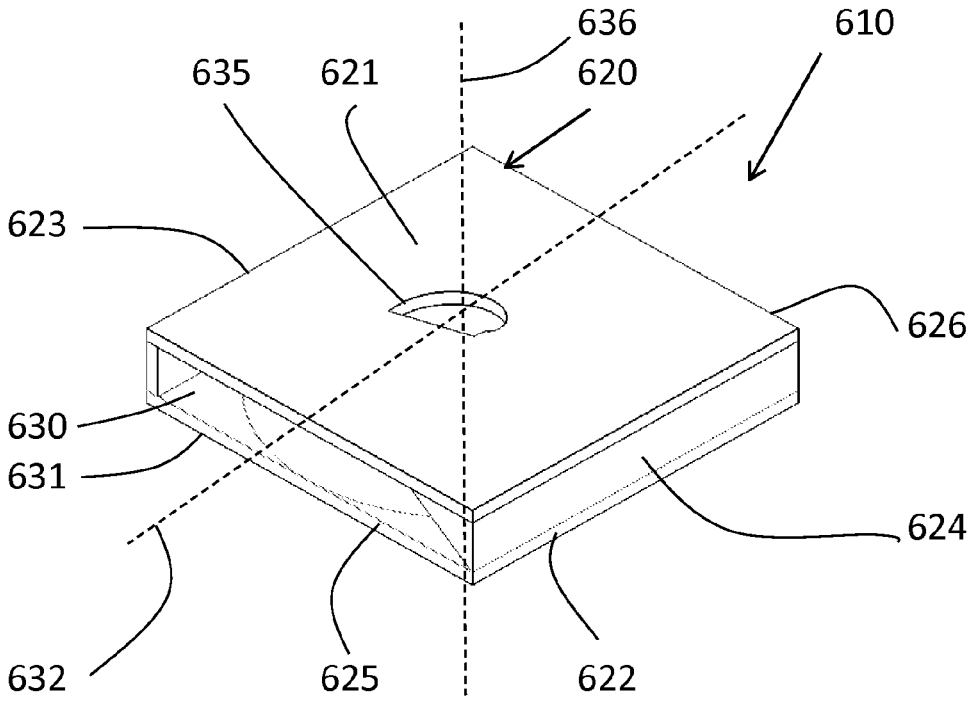
FIG. 22 is a perspective view of a port design.
Figure 23:
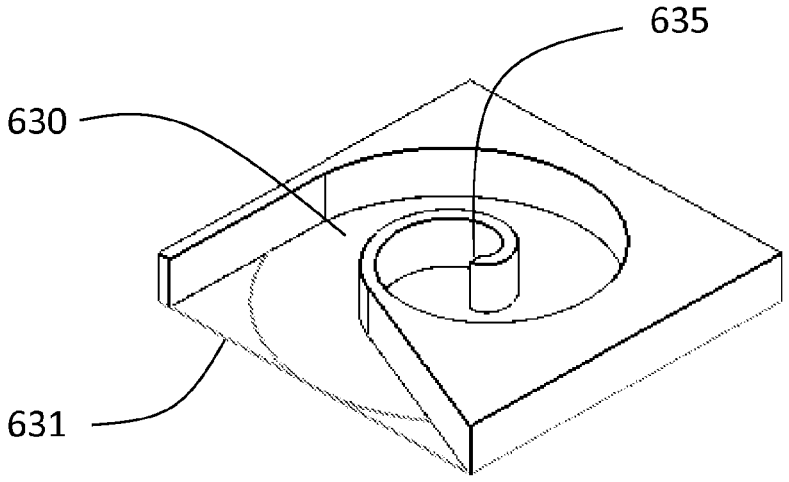
FIG. 23 is a partial view showing the internal spiral orientation of the path of the port illustrated in FIG. 22.

Turning now to FIGS. 22 and 23, it is seen that a preferred embodiment of a port 610 is provided. The port 610 has a housing 620 with a top 621, a bottom 622, sides 623 and 624, a front 625 and a rear 626. It is understood that the orientation of the port 510 can change without departing from the broad aspects of the present invention. Port 610 can be fixed or placed adjacent an enclosure (for example the enclosures illustrated herein, or otherwise).

The port 610 defines a path 630 from an entrance 631 to an exit 635. The entrance 631 is preferably located across the entire front 625 of the housing 620. The entrance 631 has an entrance axis 632. The exit 635 exits the housing 620 through the top 621 along an exit axis 636. In this regard, the exit axis 636 is generally perpendicular to the entrance axis 632.

The path 630 has a generally spiral or arcuate shape. The cross-sectional area of the path preferably continuously decreases from the entrance 631 to the exit 635. The effect of the spiral path is that the overall length of the path is increased. The overall length is preferably longer than the maximum width of the path (which preferably occurs at the entrance 631).

The spiral is preferably a golden spiral, which can be described as a series of quarter circles drawn in squares, wherein the squares have been inscribed in a golden rectangle whereby the ratio of a given square to the adjacent larger square is approximately 0.6 to 1.0.

It is appreciated that a spiral having many revolutions may also be incorporated into the present invention.

The path exit 632 can be at or adjacent an enclosure entrance.

Further, the cross-sectional area of the exit is preferably equal to the cross-sectional area of the spiral immediately adjacent the exit.

Thus it is apparent that there has been provided, in accordance with the invention, a speaker enclosure that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An enclosure comprising:

a large chamber having a driver wall;

a small chamber next to said large chamber, said small chamber comprises a first small chamber brace and a second small chamber brace, wherein said first small chamber brace and said second small chamber brace define:

a center portion having a center portion volume;

a first side portion having a first side portion volume; and a second side portion having a second side portion volume; and a baffle separating said large chamber and said small chamber, wherein a volumetric ratio of said center portion volume to the sum of said first side portion volume and said second side portion volume is approximately 0.6 to 1.0.

2. The enclosure of claim 1 wherein:

said large chamber has a large chamber volume; and said small chamber has a small chamber volume, wherein a volumetric ratio of said small chamber volume to said large chamber volume is 0.6 to 1.0.

3. The enclosure of claim 1 wherein said baffle comprises a central hole and a plurality of perimeter holes, said plurality of perimeter holes having a sum total area and the central hole having an area, wherein a ratio of area of the sum total area of said perimeter holes to the area of said central hole is approximately 0.6 to 1.0.

4. The enclosure of claim 1 wherein:

said enclosure has an enclosure rear;

said enclosure further comprises a first port and a second port, said first port and said second port being open through said enclosure rear and open to said large chamber; and said large chamber further comprises a first large chamber brace diffusing a first amount of air entering through said first port and a second large chamber brace diffusing a second amount of air entering through said second port.

5. The enclosure of claim 1 wherein said large chamber is a front chamber and said small chamber is a rear chamber.

6. An enclosure comprising:

a front chamber having a driver wall;

a rear chamber next to said front chamber, said rear chamber comprises a first rear chamber brace and a second rear chamber brace, wherein said first rear chamber brace and said second rear chamber brace define:

a center portion having a center portion volume;

a first side portion having a first side portion volume; and a second side portion having a second side portion volume; and a baffle separating said front chamber and said rear chamber, wherein a volumetric ratio of said center portion volume to the sum of said first side portion volume and said second side portion volume is approximately 0.6 to 1.0.

7. The enclosure of claim 6 wherein:

said front chamber has a front chamber volume; and said rear chamber has a rear chamber volume, wherein a volumetric ratio of said rear chamber volume to said front chamber volume is 0.6 to 1.0.

8. The enclosure of claim 6 wherein said baffle comprises a central hole and a plurality of perimeter holes, said plurality of perimeter holes having a sum total area and the central hole having an area, wherein a ratio of area of the sum total area of said perimeter holes to the area of said central hole is approximately 0.6 to 1.0.

9. The enclosure of claim 6 wherein:

said enclosure has an enclosure rear;

said enclosure further comprises a first port and a second port, said first port and said second port being open through said enclosure rear and open to said front chamber; and said front chamber further comprises a first front chamber brace diffusing a first amount of air entering through said first port and a second front chamber brace diffusing a second amount of air entering through said second port.

10. The enclosure of claim 6 wherein said front chamber is a large chamber and said rear chamber is a small chamber.

11. An enclosure comprising an enclosure outside, said enclosure comprising:

a first chamber and a first chamber brace, said first chamber brace lying in a first chamber brace plane and having a first side and a second side;

a second chamber next to said first chamber;

a rigid baffle separating said first chamber and said second chamber;

a port open to said enclosure outside, passes through said rigid baffle and is open to said first chamber, said port lying along an axis that is generally parallel to said first chamber brace plane wherein said first chamber brace diffuses an amount of air entering through said port whereby said amount of air is diffused as it passes to said first side and said second side of said first chamber brace.

12. The enclosure of claim 11 wherein:

said enclosure has an enclosure top and an enclosure bottom;

said first chamber brace spans between said enclosure bottom and said enclosure top.

13. The enclosure of claim 11 wherein said second chamber is a small chamber that comprises a first small chamber brace and a second small chamber brace, wherein said first small chamber brace and said second small chamber brace define:

a center portion having a center portion volume;

a first side portion having a first side portion volume; and a second side portion having a second side portion volume;

wherein a volumetric ratio of said center portion volume to the sum of said first side portion volume and said second side portion volume is approximately 0.6 to 1.0.

14. The enclosure of claim 11 wherein:

said first chamber is a large chamber that has a large chamber volume; and said second chamber is a small chamber that has a small chamber volume, wherein a volumetric ratio of said small chamber volume to said large chamber volume is approximately 0.6 to 1.0.

15. The enclosure of claim 11 wherein said baffle comprises a central hole and a plurality of perimeter holes, each of said central hole and said plurality of side holes having radiused edges wherein a ratio of the cross-sectional area of said side holes to the cross-sectional area of said central hole is approximately 0.6 to 1.0.

* * * * *